US009689339B2

(12) United States Patent
Kang et al.

(10) Patent No.: US 9,689,339 B2
(45) Date of Patent: Jun. 27, 2017

(54) ENGINE TORQUE CONTROL WITH FUEL MASS

(71) Applicant: GM GLOBAL TECHNOLOGY OPERATIONS LLC, Detroit, MI (US)

(72) Inventors: Jun-Mo Kang, Ann Arbor, MI (US); Orgun A. Guralp, Ann Arbor, MI (US); Sai S. V. Rajagopalan, Bloomfield Hills, MI (US); Hanho Yun, Oakland Township, MI (US); Chen-Fang Chang, Bloomfield Hills, MI (US); Paul M. Najt, Bloomfield Hills, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 160 days.

(21) Appl. No.: 14/735,660

(22) Filed: Jun. 10, 2015

(65) Prior Publication Data

US 2016/0363085 A1 Dec. 15, 2016

(51) Int. Cl.
*F02D 41/30* (2006.01)
*F02D 41/14* (2006.01)
(Continued)

(52) U.S. Cl.
CPC ..... *F02D 41/3011* (2013.01); *F02D 35/023* (2013.01); *F02D 41/14* (2013.01);
(Continued)

(58) Field of Classification Search
CPC ..... F02D 41/3011; F02D 29/02; F02D 2200/0614; F02D 2200/0616; F02D 2200/1006; G01M 15/08
(Continued)

(56) References Cited

U.S. PATENT DOCUMENTS 3,081,756 A * 3/1963 Braun ..... F02B 71/00 123/46 R
3,125,076 A * 3/1964 Mullaney ..... F02B 3/06 123/27 R (Continued)

*Primary Examiner* — Sizo Vilakazi
*Assistant Examiner* — Brian Kirby
(74) *Attorney, Agent, or Firm* — Quinn IP Law

(57) ABSTRACT

An engine assembly includes an internal combustion engine with an engine block having at least one cylinder. An intake manifold and an exhaust manifold are each fluidly connected to the at least one cylinder and define an intake manifold pressure ($p_i$) and an exhaust manifold pressure ($p_e$), respectively. A controller is operatively connected to the internal combustion engine and configured to receive a torque request ($T_R$). The controller is programmed to determine a desired fuel mass ($m_f$) for controlling a torque output of the internal combustion engine. The desired fuel mass ($m_f$) is based at least partially on the torque request ($T_R$), the intake and exhaust manifold pressures and a pressure-volume (PV) diagram of the at least one cylinder.

13 Claims, 2 Drawing Sheets

(51) Int. Cl.
*F02D 35/02* (2006.01)
*F02D 29/02* (2006.01)

(52) U.S. Cl.
CPC ..... *F02D 41/1448* (2013.01); *F02D 41/1497* (2013.01); *F02D 41/3035* (2013.01); *F02D 29/02* (2013.01); *F02D 2041/1433* (2013.01); *F02D 2200/0406* (2013.01)

(58) Field of Classification Search
USPC ..... 123/90.15, 198 F, 406.23; 701/103, 104, 701/54, 84; 60/285
See application file for complete search history.

(56) References Cited

U.S. PATENT DOCUMENTS 3,283,569 A * 11/1966 Edlund ..... G01L 3/24 702/44
3,364,735 A * 1/1968 Germann ..... G01L 23/20 708/828
3,375,711 A * 4/1968 Ives ..... F02D 41/24 73/114.14
3,799,124 A * 3/1974 Swain ..... F02M 21/0206 123/1 A
4,128,085 A * 12/1978 Kunii ..... F01L 1/14 123/316
4,261,307 A * 4/1981 Oldberg ..... F01L 13/0063 123/90.15
4,418,532 A * 12/1983 Momose ..... F01N 3/32 123/559.1
4,716,863 A * 1/1988 Pruzan ..... F01L 13/0015 123/90.12
5,255,654 A * 10/1993 Karlsson ..... F02D 9/02 123/337
5,577,474 A 11/1996 Livshiz et al.
5,740,045 A 4/1998 Livshiz et al.
6,993,427 B2 * 1/2006 Ueda ..... F02D 41/1498 123/179.16
7,127,346 B1 * 10/2006 Trombley ..... F02D 11/105 123/325
7,165,391 B2 * 1/2007 Lewis ..... F02D 13/06 123/90.15
7,206,688 B2 4/2007 Wang et al.
7,321,821 B2 * 1/2008 Kolmanovsky ..... F01L 9/04 123/478
7,526,375 B2 * 4/2009 Buslepp ..... F02D 41/0087 123/198 DB
7,536,249 B2 * 5/2009 Muller ..... F02D 41/1448 701/102
7,614,384 B2 11/2009 Livshiz et al.
7,651,440 B2 1/2010 Runde
7,905,214 B2 * 3/2011 Bauer ..... F02D 35/023 123/435
8,019,568 B2 9/2011 Lehner et al.
2004/0206068 A1 * 10/2004 Michelini ..... F01N 3/2006 60/284
2005/0205037 A1 * 9/2005 Lewis ..... B60W 10/06 123/179.16
2006/0048744 A1 * 3/2006 Castagne ..... F02D 41/005 123/305
2010/0010724 A1 * 1/2010 Tripathi ..... F02D 41/0087 701/103
2010/0057330 A1 3/2010 Whitney et al.
2011/0054744 A1 * 3/2011 Brennan ..... F02D 35/023 701/51
2011/0087419 A1 * 4/2011 Buslepp ..... F02D 35/023 701/102
2011/0208405 A1 * 8/2011 Tripathi ..... F02D 17/02 701/102
2013/0340730 A1 * 12/2013 Fischer ..... F02B 29/0406 123/568.12

* cited by examiner

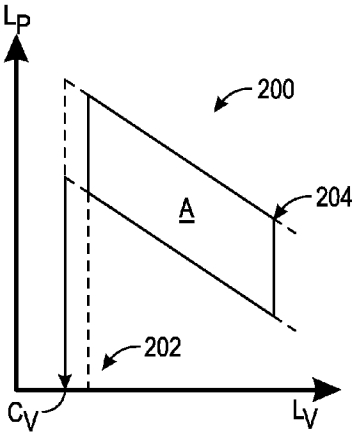
FIG. 3
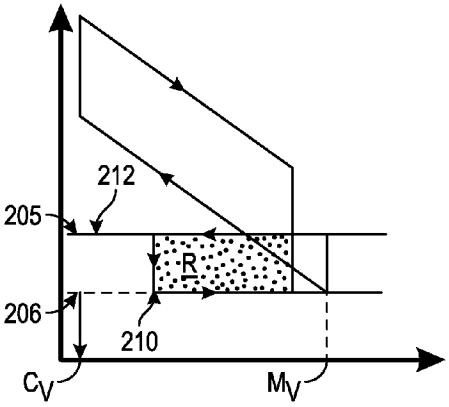
FIG. 4
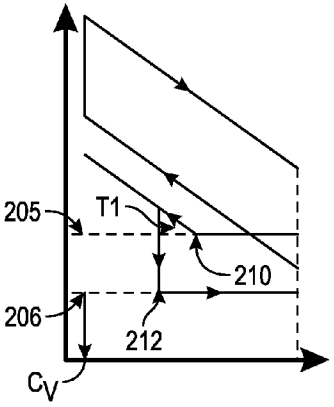
FIG. 5
FIG. 6
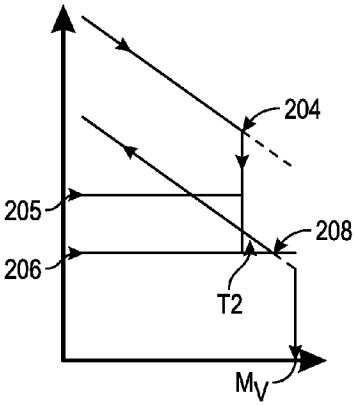
FIG. 7
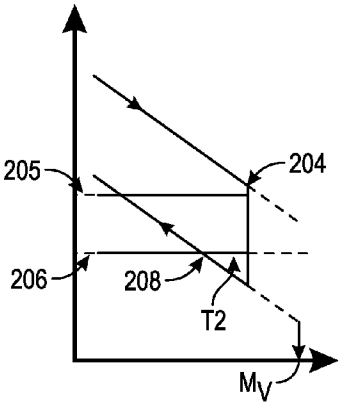
FIG. 8

ENGINE TORQUE CONTROL WITH FUEL MASS

TECHNICAL FIELD

The disclosure relates generally to control of torque in an internal combustion engine, and more specifically, to control of torque in an engine assembly with fuel mass.

BACKGROUND

Many modern engines are equipped with multiple actuators to achieve better fuel economy. However, it becomes more challenging to accurately control the torque output of an engine due to the increasing complexity of the engine system. The torque control methods for such engines typically require numerous calibrations.

SUMMARY

An engine assembly includes an internal combustion engine with an engine block having at least one cylinder. At least one piston is moveable within the at least one cylinder. An intake manifold and an exhaust manifold are each fluidly connected to the at least one cylinder and define an intake manifold pressure ($p_i$) and an exhaust manifold pressure ($p_e$), respectively. At least one intake valve and at least one exhaust valve are each in fluid communication with the at least one cylinder and have respective open and closed positions.

A controller is operatively connected to the internal combustion engine and configured to receive a torque request ($T_R$). The controller is programmed to determine a desired fuel mass ($m_f$) for controlling a torque output of the internal combustion engine. The desired fuel mass ($m_f$) is based at least partially on the torque request ($T_R$), the intake manifold pressure ($p_i$), the exhaust manifold pressure ($p_e$) and a pressure-volume (PV) diagram of the at least one cylinder. The desired fuel mass ($m_f$) improves the functioning of the vehicle by controlling the torque output of the engine with minimal calibration required.

Determining the desired fuel mass ($m_f$) includes obtaining a first function ($F_1$), via the controller, as a sum of respective geometrical areas of a plurality of geometrical shapes in the pressure-volume (PV) diagram. The first function ($F_1$) is obtained as $F_1=(A_R+A_{T1}+A_{T2})$, wherein $A_R$ is an area of a rectangle in the log-scaled pressure-volume (PV) diagram. Additionally, $A_{T1}$ and $A_{T2}$ are respective areas of a first and a second triangle in the log-scaled pressure-volume (PV) diagram.

Determining the desired fuel mass ($m_f$) includes obtaining a second function ($F_2$) as a sum of the first function ($F_1$) and a product of the torque request ($T_R$) and pi ($\pi$) such that $F_2=F_1+(T_R*\pi)$. A third function ($F_3$) is obtained as a function of a cylinder clearance volume ($V_c$), the second cylinder volume ($V_{EVO}$) and a predefined first constant ($\gamma$) such that $F_3=[1-(V_{EVO}/V_C)^{1-\gamma}]$. The desired fuel mass ($m_f$) may be obtained based on the second function ($F_2$), the third function ($F_3$), a predefined second constant ($\eta$) and a predefined third constant ($Q_{LHV}$) such that $m_f=F_2/(F_3*\eta*Q_{LHV})$.

The engine assembly includes at least one intake valve and at least one exhaust valve each in fluid communication with the cylinder and having respective open and closed positions. The cylinder defines a plurality of cylinder volumes (V), including: a first cylinder volume ($V_{EVC}$) when the (last) exhaust valve is closing; a second cylinder volume ($V_{EVO}$) when the exhaust valve is opening; a third cylinder volume ($V_{IVO}$) when the intake valve is opening; and a fourth cylinder volume ($V_{IVC}$) when the (last) intake valve is closing. When the engine is equipped with multiple intake valves (or multiple exhaust valves), the valve opening timing may be defined as the timing when any of the intake valves are opening and the valve closing timing may be defined as the moment when all the valves are closed.

The area ($A_R$) of the rectangle (R) is based at least partially on the intake manifold pressure ($p_i$), the exhaust manifold pressure ($p_e$), the first cylinder volume ($V_{EVC}$), the second cylinder volume ($V_{EVO}$) and the third cylinder volume ($V_{IVO}$). The area ($A_{T1}$) of the first triangle (T1) is based at least partially on the intake manifold pressure ($p_i$), the exhaust manifold pressure ($p_e$), the first cylinder volume ($V_{EVC}$) and the third cylinder volume ($V_{IVO}$). The area ($A_{T2}$) of the second triangle (T2) is based at least partially on the intake manifold pressure ($p_i$), the exhaust manifold pressure ($p_e$), the second cylinder volume ($V_{EVO}$) and the fourth cylinder volume ($V_{IVC}$).

The above features and advantages and other features and advantages of the present disclosure are readily apparent from the following detailed description of the best modes for carrying out the disclosure when taken in connection with the accompanying drawings.

BRIEF DESCRIPTION OF THE DRAWINGS

FIG. 3 is an example log-scaled pressure-volume (PV) diagram of the cylinder of FIG. 1;

FIG. 4 is an example log-scaled pressure-volume (PV) diagram of the cylinder of FIG. 1 when there is positive valve overlap (when intake valve opens earlier than exhaust valve closes);

FIG. 5 is an example log-scaled pressure-volume (PV) diagram around TDC (top-dead-center) when the cylinder volume when the intake valve opens is less than the cylinder volume when the exhaust valve closes ($V_{IVO}<V_{EVC}$);

FIG. 6 is an example log-scaled pressure-volume (PV) diagram around TDC (top-dead-center) when the cylinder volume when the intake valve opens is more than the cylinder volume when the exhaust valve closes ($V_{IVO}>V_{EVC}$);

FIG. 7 is an example log-scaled pressure-volume (PV) diagram around BDC (bottom-dead-center) when the cylinder volume when the intake valve closes is more than the cylinder volume when the exhaust valve opens ($V_{IVC}>V_{EVO}$); and FIG. 8 is an example log-scaled pressure-volume (PV) diagram around BDC (bottom-dead-center) when the cylinder volume when the intake valve closes is less than the cylinder volume when the exhaust valve opens ($V_{IVC}<V_{EVO}$).

DETAILED DESCRIPTION

Figure 1:
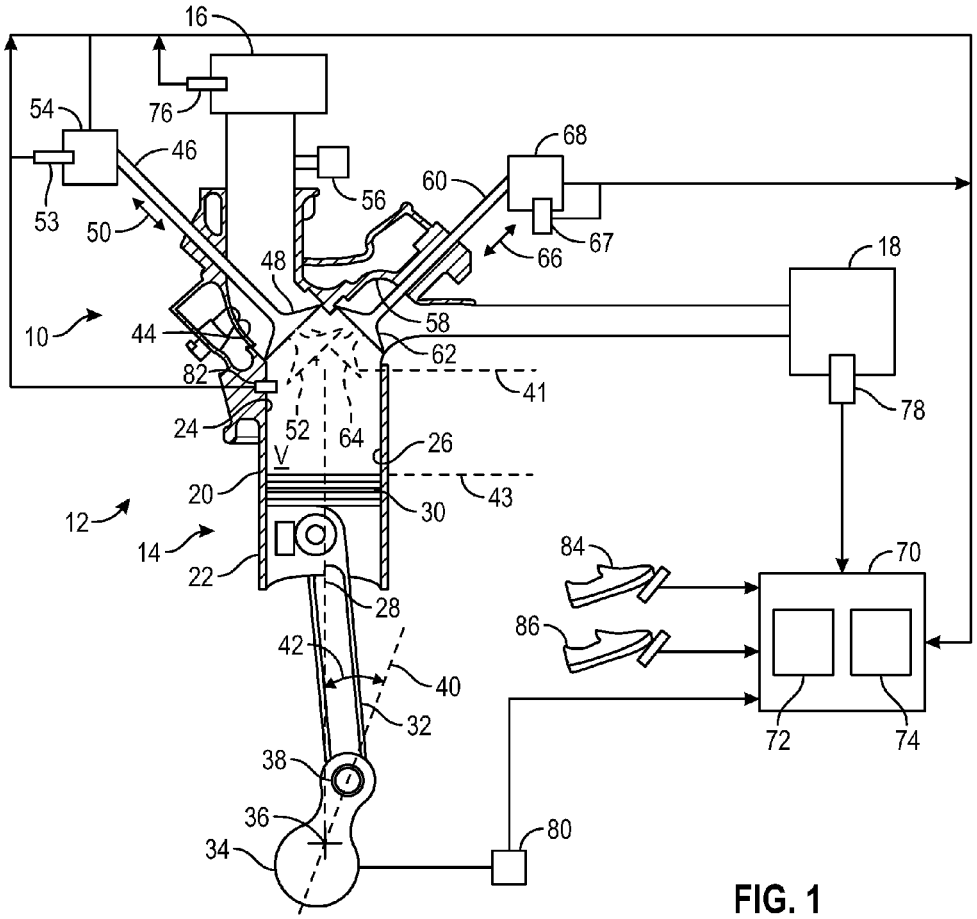
FIG. 1 is a schematic fragmentary view of a vehicle including an engine assembly with at least one cylinder having at least one piston, at least one intake valve and at least one exhaust valve.

Referring to the drawings, wherein like reference numbers refer to like components, FIG. 1 schematically illustrates a vehicle 10 having an engine assembly 12. The engine assembly 12 includes an internal combustion engine 14, referred to herein as engine 14, for combusting an air-fuel mixture in order to generate output torque. The engine assembly 12 includes an intake manifold 16 in fluid communication with the engine 14. The intake manifold 16 may be configured to receive fresh air from the atmosphere. The intake manifold 16 is fluidly coupled to the engine 14, and capable of directing air into the engine 14. The engine assembly 12 includes an exhaust manifold 18 in fluid communication with the engine 14, and capable of receiving exhaust gases from the engine 14.

Referring to FIG. 1, the engine 14 includes an engine block 20 having at least one cylinder 22. The cylinder 22 has an inner cylinder surface 24 defining a cylinder bore 26. The cylinder bore 26 extends along a bore axis 28. The bore axis 28 extends along a center of the cylinder bore 26. A piston 30 is positioned inside the cylinder 22. The piston 30 is configured to move or reciprocate inside the cylinder 22 along the bore axis 28 during the engine cycle.

The engine 14 includes a rod 32 pivotally connected to the piston 30. Due to the pivotal connection between rod 32 and the piston 30, the orientation of the rod 32 relative to the bore axis 28 changes as the piston 30 moves along the bore axis 28. The rod 32 is pivotally coupled to a crankshaft 34. Accordingly, the movement of the rod 32 (which is caused by the movement of the piston 30) causes the crankshaft 34 to rotate about its center 36. A fastener 38, such as a pin, movably couples the rod 32 to the crankshaft 34. The crankshaft 34 defines a crank axis 40 extending between the center 36 of the crankshaft 34 and the fastener 38.

Referring to FIG. 1, a crank angle 42 is defined from the bore axis 28 to the crank axis 40. As the piston 30 reciprocates along the bore axis 28, the crank angle 42 changes due to the rotation of the crankshaft 34 about its center 36. Accordingly, the position of the piston 30 in the cylinder 22 can be expressed in terms of the crank angle 42. The piston 30 can move within the cylinder 22 between a top dead center (TDC) position (i.e., when the top of the piston 30 is at the line 41) and a bottom dead center (BDC) position (i.e., when the top of the piston 30 is at the line 43). The TDC position refers to the position where the piston 30 is farthest from the crankshaft 34, whereas the BDC position refers the position where the piston 30 is closest to the crankshaft 34. When the piston 30 is in the TDC position (see line 41), the crank angle 42 may be zero (0) degrees. When the piston 30 is in the BDC position (see line 43), the crank angle 42 may be one hundred eighty (180) degrees.

Referring to FIG. 1, the engine 14 includes at least one intake port 44 in fluid communication with both the intake manifold 16 and the cylinder 22. The intake port 44 allows gases, such as air, to flow from the intake manifold 16 into the cylinder bore 26. The engine 14 includes at least one intake valve 46 capable of controlling the flow of gases between the intake manifold 16 and the cylinder 22. Each intake valve 46 is partially disposed in the intake port 44 and can move relative to the intake port 44 between a closed position 48 and an open position 52 (shown in phantom) along the direction indicated by double arrows 50. When the intake valve 46 is in the open position 52, gas, such as air, can flow from the intake manifold 16 to the cylinder 22 through the intake port 44. When the intake valve 46 is in the closed position 48, gases, such as air, are precluded from flowing between the intake manifold 16 and the cylinder 22 through the intake port 44. A first cam phaser 54 may control the movement of the intake valve 46.

Referring to FIG. 1, the engine 14 may receive fuel from a fuel injector 56. The fuel may be injected with any type of injector known to those skilled in the art and through any location in the engine 14, e.g., port fuel injection and direct injection. As noted above, the engine 14 can combust an air-fuel mixture, producing exhaust gases. The engine 14 further includes at least one exhaust port 58 in fluid communication with the exhaust manifold 18. The exhaust port 58 is also in fluid communication with the cylinder 22 and fluidly interconnects the exhaust manifold 18 and the cylinder 22. Thus, exhaust gases can flow from the cylinder 22 to the exhaust manifold 18 through the exhaust port 58.

The engine 14 further includes at least one exhaust valve 60 capable of controlling the flow of exhaust gases between the cylinder 22 and the exhaust manifold 18. Each exhaust valve 60 is partially disposed in the exhaust port 58 and can move relative to the exhaust port 58 between a closed position 62 and an open position 64 (shown in phantom) along the direction indicated by double arrows 66. When the exhaust valve 60 is in the open position 64, exhaust gases can flow from the cylinder 22 to the exhaust manifold 18 through the exhaust port 58. When the exhaust valve 60 is in the closed position 62, exhaust gases are precluded from flowing between the cylinder 22 and the exhaust manifold 18 through the exhaust port 58. A second cam phaser 68 may control the movement of the exhaust valve 60. Furthermore, the second cam phaser 68 may operate independently of the first cam phaser 54.

Referring to FIG. 1, the engine assembly 12 includes a controller 70 operatively connected to or in electronic communication with the engine 14. The controller 70 is configured to receive a torque request ($T_R$). Referring to FIG. 1, the controller 70 includes at least one processor 72 and at least one memory 74 (or any non-transitory, tangible computer readable storage medium) on which are recorded instructions for executing method 100, shown in FIG. 2, for controlling torque in the engine assembly 12 based on a desired fuel mass ($m_f$). The memory 74 can store controller-executable instruction sets, and the processor 72 can execute the controller-executable instruction sets stored in the memory 74.

The controller 70 of FIG. 1 is specifically programmed to execute the steps of the method 100 (as discussed in detail below with respect to FIG. 2) and can receive inputs from various sensors. For example, the engine assembly 12 may include a first pressure sensor 76 in communication (e.g., electronic communication) with the intake manifold 16 and the controller 70, as shown in FIG. 1. The first pressure sensor 76 is capable of measuring the pressure of the gases (e.g., air) in the intake manifold 16 (i.e., the intake manifold pressure) and sending input signals to the controller 70. The controller 70 may determine the intake manifold pressure based on the input signals from the first pressure sensor 76. The engine assembly 12 may include a mass air flow (MAF) sensor (not shown) in electronic communication with the intake manifold 16 and the controller 70.

The engine assembly 12 may include a second pressure sensor 78 in communication (e.g., electronic communication) with the controller 70 and the exhaust manifold 18, as shown in FIG. 1. The second pressure sensor 78 is capable of determining the pressure of the gases in the exhaust manifold 18 (i.e., the exhaust manifold pressure) and sending input signals to the controller 70. The controller 70 may determine the exhaust manifold pressure based on the input signals from the second pressure sensor 78. Additionally, controller 70 may be programmed to determine the exhaust manifold pressure based on other methods or sensors, without the second pressure sensor 78. The exhaust manifold pressure may be estimated by any method or mechanism known to those skilled in the art. The controller 70 is also in communication with the first and second cam phasers 54, 68 and can therefore control the operation of the intake and exhaust valves 46, 60.

Referring to FIG. 1, a crank sensor 80 is operative to monitor crankshaft rotational position, i.e., crank angle and speed. A third pressure sensor 82 may be employed to obtain the in-cylinder combustion pressure of the at least one cylinder 22. The third pressure sensor 82 may be monitored by the controller 70 to determine a net-effective-pressure (NMEP) for each cylinder 22 for each combustion cycle.

Figure 2:
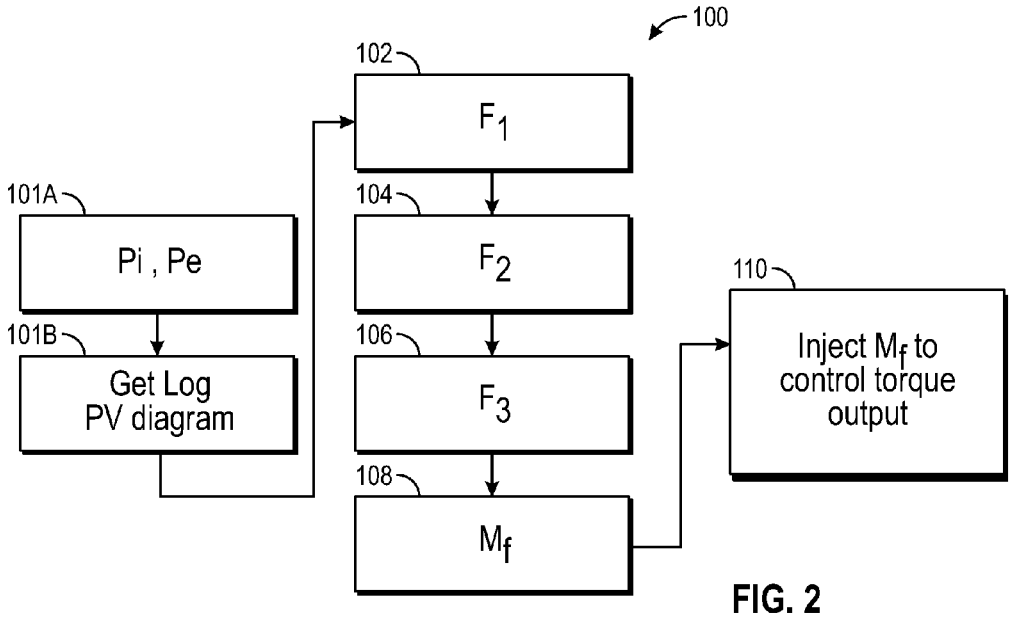
FIG. 2 is a flowchart for a method for controlling torque of the engine of FIG. 1.

Referring now to FIG. 2, a flowchart of the method 100 stored on and executable by the controller 70 of FIG. 1 is shown. Method 100 is employed for controlling torque in the engine assembly 12 based on a desired fuel mass ($m_f$). Method 100 need not be applied in the specific order recited herein. Furthermore, it is to be understood that some steps may be eliminated. The controller 70 is configured to control the torque produced by the engine 14 with the desired fuel mass ($m_f$). The desired fuel mass ($m_f$) is based at least partially on the torque request ($T_R$), the intake manifold pressure ($p_i$), the exhaust manifold pressure ($p_e$) and a pressure-volume (PV) diagram (such as example graph 200 in FIG. 3) of the at least one cylinder 22. Referring to FIG. 2, in block 101A, the controller 70 is configured to obtain the intake manifold pressure ($p_i$), the exhaust manifold pressure ($p_e$) and in block 101B, the controller 70 is configured to obtain the pressure-volume (PV) diagram (see FIG. 3).

The method 100 of FIG. 2 may be applied in an engine 14 having a homogeneous charge compression ignition (referred to herein as "HCCI") mode. HCCI mode is a form of internal combustion in which well-mixed fuel and oxidizer, such as air, are compressed to the point of auto-ignition. In the HCCI mode, fuel is injected during the intake stroke. Instead of using an electric discharge or spark to ignite a portion of the mixture, the density and temperature of the air-fuel mixture are raised by compression in the HCCI mode, until the entire mixture reacts spontaneously. The HCCI mode can be operated with lean air-to-fuel ratios since auto-ignited combustion has a low level of engine-out NOx emission, owing to a low peak combustion temperature. However, since auto-ignited combustion strongly depends on temperature, pressure and composition of air-fuel mixture in the cylinder 22, spark timing can no longer can be used to control the combustion phasing.

Referring to FIG. 2, in block 102, the controller 70 is programmed or configured to obtain a first function ($F_1$), as a sum of respective geometrical areas of a plurality of geometrical shapes in the log-scaled pressure-volume (PV) diagram. The first function ($F_1$) is obtained as:

$$F_1=(A_R+A_{T1}+A_{T2}). \tag{1}$$

Here $A_R$ is an area of a rectangle (R) in the log-scaled pressure-volume (PV) diagram in FIG. 4. Additionally, $A_{T1}$ and $A_{T2}$ are respective areas of a first and a second triangle (T1, T2) in the log-scaled pressure-volume (PV) diagram in FIG. 5-8.

FIGS. 3-8 are example log-scaled pressure-volume (PV) diagrams at various positions of intake valve 46 and exhaust valve 60. In each of FIGS. 3-8, the vertical axis represents the logarithm of pressure in the cylinder 22 (indicated as "$L_P$" in FIG. 3) and the horizontal axis represents the logarithm of the volume of the cylinder 22 (indicated as "$L_V$" in FIG. 3).

The area ($A_R$) of the rectangle (R) may be obtained from FIG. 4. The areas ($A_{T1}$, $A_{T2}$) of the first and second triangles (T1,T2) may be obtained from FIGS. 5-6 and 7-8, respectively. The first function ($F_1$) represents work done by the cylinder 22. Referring to FIG. 3, the area of the parallelogram (indicated as "A" in FIG. 3) represents indicated work done by the cylinder 22, when the timings of the closing of the intake valve 46 and the opening of the exhaust valve 60 are symmetric around the bottom-dead-center (BDC) (indicated by line 43) of the cylinder 22, assuming a polytropic compression and expansion. Numeral 202 in FIG. 3 indicates the end of combustion (EOC), which is assumed to be the same as the start of combustion (SOC) in this application.

The cylinder 22 defines a plurality of cylinder volumes (indicated as "V" in FIG. 1) varying with the respective closing and opening of the intake valve 46 and exhaust valve 60. The plurality of cylinder volumes (V) include: a first cylinder volume ($V_{EVC}$) when the (last) exhaust valve 60 is closing (moving towards position 62); a second cylinder volume ($V_{EVO}$) when the exhaust valve 60 is opening (moving towards position 64); a third cylinder volume ($V_{IVO}$) when the intake valve 46 is opening (moving towards position 52); and a fourth cylinder volume ($V_{IVC}$) when the (last) intake valve 46 is closing (moving towards position 48). When the engine 14 is equipped with multiple intake valves 46 (or multiple exhaust valves 60), the valve opening timing may be defined as the timing when any of the intake valves are opening and the valve closing timing may be defined as the moment when all the valves are closed. The cylinder volumes (V) may be determined by using known slider crank equations, the position of the crankshaft 34 (via crank sensor 80) and respective positions of the first and second camshafts 54, 68 (via first and second position sensors 53, 67, respectively). The cylinder pressures (in-cylinder combustion pressure) may be measured using the third pressure sensor 82.

As noted above, the area ($A_R$) of the rectangle (R) may be obtained from FIG. 4. When the timing of the closing of the exhaust valve 60 (EVC, indicated by numeral 210 in FIGS. 4-6) is later than or equal to the timing of the opening of the intake valve 46 (IVO, indicated by numeral 212 in FIGS. 4-6)) (i.e., positive valve overlap), the area ($A_R$) of the rectangle (R) in FIG. 4 represents the pumping work. As seen in equation (2) below, the area ($A_R$) of the rectangle (R) is based at least partially on the intake manifold pressure ($p_i$), the exhaust manifold pressure ($p_e$), the first cylinder volume ($V_{EVC}$), the second cylinder volume ($V_{EVO}$) and the third cylinder volume ($V_{IVO}$):

$$\text{The area of square} = \begin{cases} (p_e - p_i)(V_{EVO} - V_{EVC}) & \text{if } IVO < EVC \\ (p_e - p_i)(V_{EVO} - V_{IVO}) & \text{Otherwise} \end{cases} \tag{2}$$

Referring to FIGS. 4-7, the logarithm of the exhaust manifold pressure ($p_e$) is indicated by line 205 and the logarithm of the intake manifold pressure ($p_i$), indicated by line 206. As noted above, the area ($A_{T1}$) of the first triangle (T1) may be obtained from FIGS. 5-6. The area ($A_{T1}$) of the first triangle (T1) represents pumping work when the closing of the exhaust valve 60 (referred to herein as "EVC") is earlier than the timing of the opening of the intake valve 46 (referred to herein as "IVO") (i.e., negative valve overlap), and ($V_{IVO}>V_{EVC}$) or vice versa. In FIG. 5, the cylinder volume at IVO is less than the cylinder volume at EVC ($V_{IVO}<V_{EVC}$), with negative valve overlap (when EVC is earlier than IVO). In FIG. 6, the cylinder volume at IVO is more than the cylinder volume at EVC ($V_{IVO}>V_{EVC}$); with negative valve overlap (when EVC is earlier than IVO). The area ($A_{T1}$) of the first triangle (T1) may be expressed as follows:

$$\text{The area of triangle 1} = \int_{V_{EVC}}^{V_{IVO}} \left(p_e - p_e\left(\frac{V_{EVC}}{V}\right)^{\gamma}\right)dV = p_e(V_{IVO} - V_{EVC}) - \frac{p_e V_{EVC}^{\gamma}}{1-\gamma}\left(V_{IVO}^{1-\gamma} - V_{EVC}^{1-\gamma}\right) \quad (3)$$

Referring to FIGS. 7-8, example log-scaled PV diagrams are shown when the timing of the closing of the intake valve 46 (referred to herein as "IVC", 208) and the timing of the opening of the exhaust valve 60 (referred to herein as "EVO", 204) are asymmetric around the BDC. The area ($A_{T2}$) of the second triangle (T2) may be obtained from FIGS. 7-8. The area of the second triangle (T2) may be expressed as follows:

$$\text{The area of triangle 2} = \int_{V_{EVO}}^{V_{IVC}} \left(p_i\left(\frac{V_{IVC}}{V}\right)^{\gamma} - p_i\right)dV = \frac{p_i V_{IVC}^{\gamma}}{1-\gamma}\left(V_{IVC}^{1-\gamma} - V_{EVO}^{1-\gamma}\right) - p_i(V_{IVC} - V_{EVO}) \quad (4)$$

As seen in equation (3) above, the area ($A_{T1}$) of the first triangle (T1) is based at least partially on the intake manifold pressure ($p_i$), the exhaust manifold pressure ($p_e$), the first cylinder volume ($V_{EVC}$) and the third cylinder volume ($V_{IVO}$). As seen in equation (4) above, the area ($A_{T2}$) of the second triangle (T2) is based at least partially on the intake manifold pressure ($p_i$), the exhaust manifold pressure ($p_e$), the second cylinder volume ($V_{EVO}$) and the fourth cylinder volume ($V_{IVO}$).

Next, in block 104 of FIG. 2, the controller 70 is programmed or configured to obtain a second function ($F_2$), as a sum of the first function ($F_1$) and a product of the torque request ($T_R$) and pi ($\pi$) such that:

$$F_2 = F_1(T_R * \pi) \quad (5)$$

The torque request ($T_R$) may be in response to an operator input or an auto start condition monitored by the controller 70. The controller 70 may be configured to receive input signals from an operator, such as through an accelerator pedal 84 and brake pedal 86, to determine the torque request ($T_R$).

In block 106 of FIG. 2, the controller 70 is programmed or configured to obtain a third function ($F_3$), based at least partially on a cylinder clearance volume ($V_c$), the second cylinder volume ($V_{EVO}$) when the exhaust valve 60 is opening and a predefined first constant ($\gamma$) such that:

$$F_3 = [1 - (V_{EVO}/V_C)^{1-\gamma}] \quad (6)$$

As understood by those skilled in the art, a cylinder clearance volume ($V_c$) is the volume of the cylinder 22 when the top of the piston 30 is at top dead center (TDC) (indicated by line 41). The cylinder clearance volume is indicated in FIGS. 3-6 as "$C_v$". The maximum cylinder volume is indicated in FIGS. 7-8 as "$M_v$". The predefined first constant ($\gamma$) is a polytropic coefficient. In a non-limiting example, the predefined first constant ($\gamma$) is about 1.4.

In block 108 of FIG. 2, the controller 70 is programmed or configured to obtain the desired fuel mass ($m_f$), based at least partially on the second function ($F_2$), the third function ($F_3$), a predefined second constant ($\eta$) and a predefined third constant ($Q_{LHV}$) such that:

$$m_f = F_2/(F_3 * \eta * Q_{LHV}) \quad (7)$$

The controller 70 may store the predefined first, second and third constants in the memory 74. The predefined third constant ($Q_{LHV}$) is the low-heating value of fuel. In a non-limiting example, the predefined third constant ($Q_{LHV}$) is between 44 and 46 MJ per kilogram. The predefined second constant ($\eta$) is a measure of combustion efficiency and may be set to be the average of combustion efficiencies obtained from calibration data.

The desired fuel mass ($m_f$), obtained from Eq. (7), may be directly applied to the engine 14 once combustion stability is guaranteed. Referring to FIG. 2, in block 110, the controller 70 is configured to control a torque output of the engine 14 by injecting the desired fuel mass into the at least one cylinder 22. In HCCI mode, there is a range of lean air-to-fuel ratios where auto-ignition occurs given an operating condition. Thus, the desired fuel mass may be trimmed/truncated in order to be within the range of air-fuel ratios where auto-ignition is guaranteed. The final fuel mass to inject in the cylinder 22, $m_f^{final}$, may be determined as follows, where $m_f^{max}$ and $m_f^{min}$ are the maximum and the minimum fuel bounds for stable auto-ignited combustion given an operating condition, respectively:

$$m_f^{final} = \max(\min(m_f, m_f^{max}), m_f^{min}).$$

In summary, the desired fuel mass ($m_f$) is tailored to produce an engine torque corresponding to the torque request ($T_R$). The controller 70 (and execution of the method 100) improves the functioning of the vehicle by controlling the torque output of a complex engine system with minimal calibration required. The controller 70 of FIG. 1 may be an integral portion of, or a separate module operatively connected to, other controllers of the vehicle 10, such as the engine controller. The vehicle 10 may be any passenger or commercial automobile such as a hybrid electric vehicle, including a plug-in hybrid electric vehicle, an extended range electric vehicle, or other vehicles. The vehicle 10 may take many different forms and include multiple and/or alternate components and facilities.

The controller 70 includes a computer-readable medium (also referred to as a processor-readable medium), including any non-transitory (e.g., tangible) medium that participates in providing data (e.g., instructions) that may be read by a computer (e.g., by a processor of a computer). Such a medium may take many forms, including, but not limited to, non-volatile media and volatile media. Non-volatile media may include, for example, optical or magnetic disks and other persistent memory. Volatile media may include, for example, dynamic random access memory (DRAM), which may constitute a main memory. Such instructions may be transmitted by one or more transmission media, including coaxial cables, copper wire and fiber optics, including the wires that comprise a system bus coupled to a processor of a computer. Some forms of computer-readable media include, for example, a floppy disk, a flexible disk, hard disk, magnetic tape, any other magnetic medium, a CD-ROM, DVD, any other optical medium, punch cards, paper tape, any other physical medium with patterns of holes, a RAM, a PROM, an EPROM, a FLASH-EEPROM, any other memory chip or cartridge, or any other medium from which a computer can read.

Look-up tables, databases, data repositories or other data stores described herein may include various kinds of mechanisms for storing, accessing, and retrieving various kinds of data, including a hierarchical database, a set of files in a file system, an application database in a proprietary format, a relational database management system (RDBMS), etc. Each such data store may be included within a computing device employing a computer operating system such as one of those mentioned above, and may be accessed via a network in any one or more of a variety of manners. A file system may be accessible from a computer operating system, and may include files stored in various formats. An RDBMS may employ the Structured Query Language (SQL) in addition to a language for creating, storing, editing, and executing stored procedures, such as the PL/SQL language mentioned above.

The detailed description and the drawings or figures are supportive and descriptive of the disclosure, but the scope of the disclosure is defined solely by the claims. While some of the best modes and other embodiments for carrying out the claimed disclosure have been described in detail, various alternative designs and embodiments exist for practicing the disclosure defined in the appended claims. Furthermore, the embodiments shown in the drawings or the characteristics of various embodiments mentioned in the present description are not necessarily to be understood as embodiments independent of each other. Rather, it is possible that each of the characteristics described in one of the examples of an embodiment can be combined with one or a plurality of other desired characteristics from other embodiments, resulting in other embodiments not described in words or by reference to the drawings. Accordingly, such other embodiments fall within the framework of the scope of the appended claims.

The invention claimed is:

1. An engine assembly comprising:

an internal combustion engine including an engine block having at least one cylinder, at least one piston moveable within the at least one cylinder;

an intake manifold and an exhaust manifold, each fluidly connected to the at least one cylinder and defining an intake manifold pressure ($p_i$) and an exhaust manifold pressure ($p_e$), respectively;

at least one intake valve and at least one exhaust valve each in fluid communication with the at least one cylinder and having respective open and closed positions;

a fuel injector in fluid communication with the at least one cylinder;

wherein the at least one cylinder defines a plurality of cylinder volumes (V), including a second cylinder volume ($V_{EVO}$) when the exhaust valve is in the respective open position;

a controller operatively connected to the internal combustion engine and configured to receive a torque request ($T_R$), the intake manifold pressure and the exhaust manifold pressure;

wherein the controller is programmed to:

obtain a log-scaled pressure-volume (PV) diagram of the at least one cylinder based at least partially on the intake manifold pressure ($p_i$) and the exhaust manifold pressure ($p_e$);

obtain a first function ($F_1$) as a sum of respective geometrical areas of a plurality of geometrical shapes in the log-scaled pressure-volume (PV) diagram of the at least one cylinder;

obtain a second function ($F_2$) as a sum of the first function ($F_1$) and a product of the request ($T_R$) and pi ($\pi$) such that $F_2=F_1+(T_R*\pi)$;

obtain a third function ($F_3$) based at least partially on a cylinder clearance volume ($V_c$), the second cylinder volume ($V_{EVO}$) and a predefined first constant ($\gamma$) such that $F_3=[1-(V_{EVO}/V_C)^{1-\gamma}]$;

determine a desired fuel mass ($m_f$) based at least partially on the torque request ($T_R$), the first function ($F_1$), the second function ($F_2$) and the third function ($F_3$); and control a torque output of the internal combustion engine by injecting the desired fuel mass into the at least one cylinder, via the fuel injector.

2. The engine assembly of claim 1, wherein the a plurality of cylinder volumes (V) includes: a first cylinder volume ($V_{EVC}$) when the exhaust valve is in the respective closed position, a third cylinder volume ($V_{IVO}$) when the intake valve is in the respective open position; and a fourth cylinder volume ($V_{IVC}$) when the intake valve is in the respective closed position.

3. The engine assembly of claim 2, wherein:

the first function ($F_1$) is defined as $F_1=(A_R+A_{T1}+A_{T2}$;

wherein $A_R$ is an area of a rectangle in the log-scaled pressure-volume (PV) diagram; and wherein $A_{T1}$ and $A_{T2}$ are respective areas of a first and a second triangle in the log-scaled pressure-volume (PV) diagram.

4. The engine assembly of claim 3, wherein the area of the rectangle ($A_R$) is based at least partially on the intake manifold pressure ($p_i$), the exhaust manifold pressure ($p_e$), the first cylinder volume ($V_{EVC}$), the second cylinder volume ($V_{EVO}$) and the third cylinder volume ($V_{IVO}$).

5. The engine assembly of claim 3, wherein the area of the first triangle ($A_{T1}$) is based at least partially on the intake manifold pressure ($p_i$), the exhaust manifold pressure ($p_e$), the first cylinder volume ($V_{EVC}$) and the third cylinder volume ($V_{IVO}$).

6. The engine assembly of claim 3, wherein the area of the second triangle ($A_{T2}$) is based at least partially on the intake manifold pressure ($p_i$), the exhaust manifold pressure ($p_e$), the second cylinder volume ($V_{EVO}$) and the fourth cylinder volume ($V_{IVC}$).

7. The engine assembly of claim 1, wherein:

the desired fuel mass ($m_f$) is based at least partially on the second function ($F_2$), the third function ($F_3$), a predefined second constant ($\eta$) and a predefined third constant ($Q_{LHV}$) such that $m_f=F_2/(F_3*\eta*Q_{LHV})$.

8. A method for controlling torque output in an engine assembly with a desired fuel mass ($m_f$), the engine assembly including an internal combustion engine having an engine block with at least one cylinder, at least one piston moveable within the at least one cylinder; at least one intake valve and at least one exhaust valve each in fluid communication with the at least one cylinder and having respective open and closed positions, a fuel injector in fluid communication with the at least one cylinder, and a controller configured to receive a torque request ($T_R$), an intake manifold pressure, and an exhaust manifold pressure, the method comprising:

obtaining a log-scaled pressure-volume (PV) diagram of the at least one cylinder based at least partially on the intake manifold pressure ($p_i$) and the exhaust manifold pressure ($p_e$);

obtaining a first function ($F_1$), via the controller, as a sum of respective geometrical areas of a plurality of geometrical shapes in the pressure-volume (PV) diagram such that ($F_1=A_R+A_{T1}+A_{T2}$);

wherein $A_R$ is an area of a rectangle in the log-scaled pressure versus volume (PV) diagram of the at least one cylinder;

wherein $A_{T1}$ and $A_{T2}$ are respective areas of a first and a second triangle in the log-scaled pressure versus volume (PV) diagram;

obtaining a second function ($F_2$) as a sum of the first function ($F_1$) and a product of the torque request ($T_R$) and pi ($\pi$) such that $F_2=F_1+(T_R*\pi)$;

obtaining a third function ($F_3$) based at least partially on a cylinder clearance volume ($V_c$), a second cylinder volume ($V_{EVO}$) when the at least one exhaust valve is in the respective open position and a predefined first constant ($\gamma$) such that $F_3=[1-(V_{EVO}/V_C)^{1-\gamma}]$;

obtaining a desired fuel mass based at least partially on the torque request, the first function ($F_1$), the second function ($F_2$) and the third function ($F_3$); and controlling the torque output of the engine by injecting the desired fuel mass into the at least one cylinder, via the fuel injector.

9. The method of claim 8, wherein the area of the rectangle ($A_R$) is based at least partially on the intake manifold pressure ($p_i$), the exhaust manifold pressure ($p_e$), a first cylinder volume ($V_{EVC}$) when the exhaust valve is in the respective closed position, the second cylinder volume ($V_{EVO}$) and a third cylinder volume ($V_{IVO}$) when the intake valve is in the respective open position.

10. The method of claim 8, wherein the area of the first triangle ($A_{T1}$) is based at least partially on the intake manifold pressure ($p_i$), the exhaust manifold pressure ($p_e$), a first cylinder volume ($V_{EVC}$) when the exhaust valve is in the respective closed position and a third cylinder volume ($V_{IVO}$) when the intake valve is in the respective open position.

11. The method of claim 8, wherein the area of the second triangle ($A_{T2}$) is based at least partially on the intake manifold pressure ($p_i$), the exhaust manifold pressure ($p_e$), the second cylinder volume ($V_{EVO}$) and a fourth cylinder volume ($V_{IVC}$) when the intake valve is in the respective closed position.

12. The method of claim 8, wherein:

the desired fuel mass ($m_f$) is based at least partially on the second function ($F_2$), the third function ($F_3$), a predefined second constant ($\eta$) and a predefined third constant ($Q_{LHV}$) such that $m_f=F_2/(F_3*\eta*Q_{LHV})$.

13. A method for controlling torque output in a vehicle with a desired fuel mass ($m_f$), the vehicle including an internal combustion engine having an engine block with at least one cylinder, at least one piston moveable within the at least one cylinder; a fuel injector in fluid communication with the at least one cylinder; at least one intake valve and at least one exhaust valve each in fluid communication with the at least one cylinder and having respective open and closed positions, and a controller configured to receive a torque request ($T_R$), an intake manifold pressure, and an exhaust manifold pressure, the method comprising:

obtaining a first function ($F_1$), via the controller, as a sum of respective geometrical areas of a plurality of geometrical shapes in the log-scaled pressure-volume (PV) diagram of the at least one cylinder;

obtaining a second function ($F_2$), via the controller, as a sum of the first function ($F_1$) and a product of the torque request ($T_R$) and pi ($\pi$) such that $F_2=F_1+(T_R*\pi)$;

obtaining a third function ($F_3$), via the controller, based at least partially on a cylinder clearance volume ($V_c$), a second cylinder volume ($V_{EVO}$) when the exhaust valve is in the respective open position and a predefined first constant ($\gamma$) such that $F_3=[1-(V_{EVO}/V_C)^{1-\gamma}]$;

obtaining the desired fuel mass ($m_f$), via the controller, based at least partially on the second function ($F_2$), the third function ($F_3$), a predefined second constant ($\eta$) and a predefined third constant ($Q_{LHV}$) such that $m_f=F_2/(F_3*\eta*Q_{LHV})$; and controlling the torque output of the internal combustion engine by injecting the desired fuel mass into the at least one cylinder, via the fuel injector.

* * * * *